US012446643B2

(12) United States Patent
Shimamoto et al.

(10) Patent No.: US 12,446,643 B2
(45) Date of Patent: Oct. 21, 2025

(54) CORE-SHEATH COMPOSITE FIBER FOR ARTIFICIAL HAIR AND HEADWEAR PRODUCT THAT INCLUDES SAME

(71) Applicant: KANEKA CORPORATION, Osaka (JP)

(72) Inventors: Hitoshi Shimamoto, Osaka (JP); Masaru Anahara, Osaka (JP)

(73) Assignee: KANEKA CORPORATION, Osaka (JP)

( * ) Notice: Subject to any disclaimer, the term of this patent is extended or adjusted under 35 U.S.C. 154(b) by 560 days.

(21) Appl. No.: 17/988,984

(22) Filed: Nov. 17, 2022

(65) Prior Publication Data

US 2023/0096590 A1 Mar. 30, 2023

Related U.S. Application Data

(63) Continuation of application No. PCT/JP2021/020253, filed on May 27, 2021.

(30) Foreign Application Priority Data

Jul. 1, 2020 (JP) ..... 2020-114158

(51) Int. Cl.

| | |
|---|---|
| ***A41G 3/00*** | (2006.01) |
| ***D01D 5/34*** | (2006.01) |
| ***D01F 1/07*** | (2006.01) |
| ***D01F 8/12*** | (2006.01) |
| ***D01F 8/14*** | (2006.01) |

(52) U.S. Cl.

CPC ..... *A41G 3/0083* (2013.01); *D01D 5/34* (2013.01); *D01F 1/07* (2013.01); *D01F 8/12* (2013.01); *D01F 8/14* (2013.01); *D10B 2401/04* (2013.01); *D10B 2503/08* (2013.01)

(58) Field of Classification Search

CPC ..... A41G 3/0083; D01F 8/12; D01F 8/14; D01F 1/07; D01D 5/34; D10B 2401/04; D10B 2503/08

See application file for complete search history.

(56) References Cited

U.S. PATENT DOCUMENTS

| | | | |
|---|---|---|---|
| 2010/0229882 | A1 | 9/2010 | Sotokawa et al. |
| 2019/0090565 | A1 | 3/2019 | Miyata et al. |
| 2020/0024774 | A1 | 1/2020 | Yasutomo et al. |

FOREIGN PATENT DOCUMENTS

| | | | |
|---|---|---|---|
| EP | 1992242 | A1 | 11/2008 |
| EP | 3603432 | A1 | 2/2020 |
| WO | 2007094289 | A1 | 8/2007 |
| WO | 2014033935 | A1 | 3/2014 |
| WO | 2017187843 | A1 | 11/2017 |
| WO | 2018179803 | A1 | 10/2018 |

OTHER PUBLICATIONS

International Search Report issued in corresponding International Application No. PCT/JP2021/020253, mailed Aug. 10, 2021, with translation (5 pages).

Written Opinion issued in corresponding International Application No. PCT/JP2021/020253, mailed Aug. 10, 2021 (3 pages).

*Primary Examiner* — Patrick D Niland

(74) *Attorney, Agent, or Firm* — Osha Bergman Watanabe & Burton LLP

(57) ABSTRACT

A core-sheath conjugate fiber for artificial hair has a core-sheath structure including a core and a sheath covering the core. The core is composed of a core resin composition containing a polyester-based resin, and the sheath is composed of a sheath resin composition containing a polyamide-based resin. The core resin composition contains a bromine-based flame retardant and a flame retardant auxiliary. The sheath resin composition contains a phosphorus-based flame retardant. The phosphorus-based flame retardant contains at least one selected from the group consisting of a zinc phosphinate and a condensed phosphate ester compound.

19 Claims, No Drawings

CORE-SHEATH COMPOSITE FIBER FOR ARTIFICIAL HAIR AND HEADWEAR PRODUCT THAT INCLUDES SAME

TECHNICAL FIELD

One or more embodiments of the present invention relate to core-sheath conjugate fibers for artificial hair that have a core-sheath structure and can be used as an alternative to human hair, and hair ornaments including the core-sheath conjugate fibers for artificial hair.

BACKGROUND

Human hair has conventionally been used for hair ornaments such as hairpieces, hair wigs, hair extensions, hair bands, and doll hair. However, in recent years, it has become difficult to obtain human hair, and the price of human hair has been rising. For this reason, there is a growing demand for artificial hair that can replace human hair. Examples of synthetic fibers used for artificial hair include acrylic fibers, vinyl chloride fibers, vinylidene chloride fibers, polyester fibers, polyamide fibers, and polyolefin fibers.

Artificial hair is required to have properties similar to those of human hair such as texture, appearance, and combing property. Further, in addition to the above properties, artificial hair is recently required to have flame resistance in terms of safety. For example, Patent Document 1 proposes an artificial hair fiber with a texture similar to human hair. The artificial hair fiber has a core-sheath structure that includes a core composed of a resin composition containing polyester and a sheath composed of a resin composition containing polyamide. Patent Document 1 further discloses the addition of a bromine-based flame retardant to the core resin composition and/or the sheath resin composition to impart flame resistance to the artificial hair fiber.

PATENT DOCUMENTS

Patent Document 1: WO 2017/187843 A1

However, although the core-sheath conjugate fibers for artificial hair of Patent Document 1 feel like human hair, when a large amount of the bromine-based flame retardant is added to the sheath resin composition containing polyamide in order to improve the flame resistance, the texture and gloss of the fibers will be far from those of human hair, and the combing property will also be impaired. On the other hand, when the amount of the flame retardant is reduced so that the fibers resemble human hair in texture, the flame resistance of the fibers will be lower than that of human hair. Thus, it is still difficult to ensure both the flame resistance and the properties such as texture, gloss, and combing property of the core-sheath conjugate fibers for artificial hair.

SUMMARY

One or more embodiments of the present invention provide fibers for artificial hair that have a texture and gloss similar to human hair, good combing property, and high flame resistance, and hair ornaments including the fibers for artificial hair.

One or more embodiments of the present invention relate to a core-sheath conjugate fiber for artificial hair that includes a core and a sheath covering the core. The core is composed of a core resin composition containing a polyester-based resin, and the sheath is composed of a sheath resin composition containing a polyamide-based resin. The core resin composition contains a bromine-based flame retardant and a flame retardant auxiliary. The sheath resin composition contains a phosphorus-based flame retardant. The phosphorus-based flame retardant contains at least one selected from the group consisting of a zinc phosphinate and a condensed phosphate ester compound. A total amount of the bromine-based flame retardant, the phosphorus-based flame retardant, and the flame retardant auxiliary in the core-sheath conjugate fiber for artificial hair is 20 parts by weight or more and 40 parts by weight or less with respect to 100 parts by weight of a total amount of a main component resin of the core and a main component resin of the sheath.

One or more embodiments of the present invention also relate to a hair ornament including the core-sheath conjugate fiber for artificial hair.

One or more embodiments of the present invention can provide core-sheath conjugate fibers for artificial hair that have a texture and gloss similar to human hair, good combing property, and high flame resistance, and hair ornaments including the core-sheath conjugate fibers for artificial hair.

DETAILED DESCRIPTION

The present inventors conducted intensive studies and found that fibers for artificial hair with high flame resistance could be obtained without impairing the texture, gloss, and combing property of the fibers, provided that the fibers have a core-sheath structure that includes a core composed of a core resin composition containing a polyester-based resin and a sheath composed of a sheath resin composition containing a polyamide-based resin, and a predetermined flame retardant is added to each of the core resin composition and the sheath resin composition.

<Structure of Core-Sheath Conjugate Fiber>

A core-sheath conjugate fiber for artificial hair has a core-sheath structure that includes a core and a sheath covering the core.

The core-sheath conjugate fiber may have either a concentric structure or an eccentric structure as long as the core is inside the sheath. In the concentric structure, the center of the core coincides with the center of the fiber. In the eccentric structure, the center of the core does not coincide with, but deviates from the center of the fiber.

The cross-sectional shape of the core-sheath conjugate fiber may be a circular shape, an elliptical shape, or any other shape such as a multilobed shape. The cross-sectional shape of the core may be a circular shape, an elliptical shape, or any other shape such as a multilobed shape. The cross-sectional shape of the core-sheath conjugate fiber and the cross-sectional shape of the core may be the same or different.

A core-to-sheath area ratio (also referred to as a core-to-sheath ratio in the following) of the core to the sheath may be 2:8 to 7:3, or 3:7 to 6:4. The core-to-sheath ratio within the above range can reduce the separation of the two components and facilitate the formation of the core-sheath conjugate fiber.

The core-sheath conjugate fiber is not particularly limited as long as the core is composed of a resin composition containing a polyester-based resin, and the sheath is composed of a resin composition containing a polyamide-based resin. However, as will be described later, from the viewpoint of making the texture and gloss of the fiber more similar to human hair and further improving the combing property and the flame resistance, it is preferable that the core is composed of a polyester-based resin composition that contains a polyester-based resin as the main component resin, and the sheath is composed of a polyamide-based resin composition that contains a polyamide-based resin as the main component resin. It is more preferable that the core is composed of a polyester-based resin composition that contains, as the main component resin, at least one polyester-based resin selected from the group consisting of polyalkylene terephthalate and a copolyester mainly containing polyalkylene terephthalate, and the sheath is composed of a polyamide-based resin composition that contains, as the main component resin, a polyamide-based resin mainly containing at least one selected from the group consisting of nylon 6 and nylon 66.

The core contains a bromine-based flame retardant and a flame retardant auxiliary. The sheath contains at least a phosphorus-based flame retardant. This configuration can provide the core-sheath conjugate fiber with high flame resistance, good gloss, and excellent combing property and texture.

When the phosphorus-based flame retardant and the bromine-based flame retardant are used in combination as a flame retardant in the sheath, the core-sheath conjugate fiber can have a texture and gloss similar to human hair, good combing property, and a high level of curl setting properties and flame resistance, despite the use of the bromine-based flame retardant.

To achieve a texture and gloss similar to human hair, good combing property, and high flame resistance, the total amount of the bromine-based flame retardant, the phosphorus-based flame retardant, and the flame retardant auxiliary in the core-sheath conjugate fiber is 20 parts by weight or more and 40 parts by weight or less, and preferably 20 parts by weight or more and 30 parts by weight or less with respect to 100 parts by weight of the total amount of the main component resin of the core and the main component resin of the sheath.

When the total amount of the main component resin of the core and the main component resin of the sheath in the core-sheath conjugate fiber is 100 parts by weight, the amount of the main component resin of the core and the amount of the main component resin of the sheath are calculated based on the core-to-sheath ratio. For example, when the core-to-sheath ratio is 5:5, the amount of the main component resin of the core is 50 parts by weight and the amount of the main component resin of the sheath is 50 parts by weight. When the core-to-sheath ratio is 7:3, the amount of the main component resin of the core is 70 parts by weight and the amount of the main component resin of the sheath is 30 parts by weight.

<Flame Retardant and Flame Retardant Auxiliary in Core>

In the present disclosure, the "main component resin of the core" means the resin having a higher content than any other resin in the core resin composition. The main component resin of the core may be a polyester-based resin. The content of the main component resin is more than 50% by weight, preferably 70% by weight or more, more preferably 85% by weight or more, even more preferably 90% by weight or more, still more preferably 95% by weight or more, and further preferably 100% by weight with respect to 100% by weight of the total content of the resins in the core resin composition.

The total amount of the bromine-based flame retardant and the flame retardant auxiliary in the core resin composition may be 20 parts by weight or more and 40 parts by weight or less with respect to 100 parts by weight of the main component resin. This makes the texture of the core-sheath conjugate fiber similar to human hair, and also improves the gloss, flame resistance, and combing property of the core-sheath conjugate fiber.

The core resin composition is not particularly limited, and contains the bromine-based flame retardant preferably in an amount of 20 parts by weight or more and 35 parts by weight or less with respect to 100 parts by weight of the main component resin from the viewpoint of ensuring the gloss and the flame resistance.

The core resin composition is not particularly limited, and contains the flame retardant auxiliary preferably in an amount of 1 part by weight or more and 5 parts by weight or less, and more preferably in an amount of 2 parts by weight or more and 3 parts by weight or less with respect to 100 parts by weight of the main component resin from the viewpoint of ensuring the gloss and the flame resistance.

<Flame Retardant and Flame Retardant Auxiliary in Sheath>

In the present disclosure, the "main component resin of the sheath" means the resin having a higher content than any other resin in the sheath resin composition. The main component resin of the sheath may be a polyamide-based resin. The content of the main component resin is more than 50% by weight, preferably 75% by weight or more, more preferably 85% by weight or more, even more preferably 90% by weight or more, still more preferably 95% by weight or more, and further preferably 100% by weight with respect to 100% by weight of the total content of the resins in the sheath resin composition.

The amount of the phosphorus-based flame retardant in the sheath resin composition may be 3 parts by weight or more and 20 parts by weight or less with respect to 100 parts by weight of the main component resin. This makes the texture of the core-sheath conjugate fiber similar to human hair, and also improves the gloss, flame resistance, and combing property of the core-sheath conjugate fiber.

The sheath resin composition may contain the bromine-based flame retardant in an amount of 5 parts by weight or more and 20 parts by weight or less, or in an amount of 5 parts by weight or more and 15 parts by weight or less with respect to 100 parts by weight of the main component resin from the viewpoint of ensuring the texture, the gloss, and the flame resistance.

The sheath resin composition may contain the flame retardant auxiliary in an amount of 1 part by weight or more and 5 parts by weight or less, or in an amount of 2 parts by weight or more and 3 parts by weight or less with respect to 100 parts by weight of the main component resin from the viewpoint of ensuring the gloss and the flame resistance.

<Bromine-Based Flame Retardant>

Examples of the bromine-based flame retardant include, but are not particularly limited to, the following: a brominated epoxy-based flame retardant; bromine-containing phosphate esters such as pentabromotoluene, hexabromobenzene, decabromodiphenyl, decabromodiphenyl ether, bis(tribromophenoxy)ethane, tetrabromophthalic anhydride, ethylene bis(tetrabromophthalimide), ethylene bis(pentabromophenyl), octabromotrimethylphenylindan, and tris(tribromoneopentyl)phosphate; brominated polystyrenes; brominated polybenzyl acrylates; brominated phenoxy resins; brominated polycarbonate oligomers; tetrabromobisphenol A and tetrabromobisphenol A derivatives such as tetrabromobisphenol A-bis(2,3-dibromopropyl ether), tetrabromobisphenol A-bis(allyl ether), and tetrabromobisphenol A-bis(hydroxyethyl ether); bromine-containing triazine compounds such as tris(tribromophenoxy)triazine; and bromine-containing isocyanuric acid compounds such as tris(2,3-dibromopropyl)isocyanurate. In particular, the brominated epoxy-based flame retardant is preferred in terms of heat resistance and flame resistance.

The brominated epoxy-based flame retardant may have an epoxy group or tribromophenol at the end of the molecule as a material. The structure of the brominated epoxy-based flame retardant after melt kneading is not particularly limited, and may have 80 mol % or more of a constitutional unit represented by the following chemical formula (1), where the total number of the constitutional unit represented by the chemical formula (1) and other constitutional units in which at least a part of the chemical formula (1) has been modified is taken as 100 mol %. The structure at the end of the molecule of the brominated epoxy-based flame retardant may be changed after melt kneading. For example, the end of the molecule of the brominated epoxy-based flame retardant may be replaced by groups other than the epoxy group or tribromophenol, such as a hydroxyl group, a phosphoric acid group, and a phosphoric acid group. Alternatively, the end of the molecule of the brominated epoxy-based flame retardant may be bound to a polyester component through an ester group.

[Chemical formula 1]

(1)

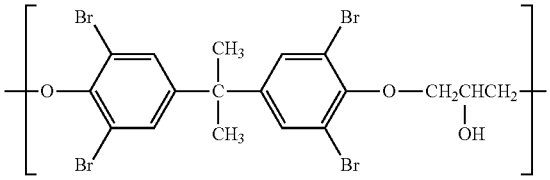

A part of the structure of the brominated epoxy-based flame retardant, except for the end of the molecule, may also be changed. For example, the secondary hydroxyl group and the epoxy group of the brominated epoxy-based flame retardant may be bound together to form a branched structure. Moreover, a part of the bromine of the chemical formula (1) may be eliminated or added if the bromine content in the molecule of the brominated epoxy-based flame retardant is not significantly changed.

The brominated epoxy-based flame retardant may be, e.g., a polymeric brominated epoxy-based flame retardant as represented by the following general formula (2). In the general formula (2), m is 1 to 1000. The polymeric brominated epoxy-based flame retardant represented by the general formula (2) may be a commercially available product such as a brominated epoxy-based flame retardant (trade name "SR-T2MP") manufactured by Sakamoto Yakuhin Kogyo Co., Ltd.

<Flame Retardant Auxiliary>

The flame retardant auxiliary is not particularly limited, and may be, e.g., an antimony-based compound, a composite metal containing antimony, or a composite metal containing zinc in terms of flame resistance. Examples of the antimony-based compound include antimony trioxide, antimony tetroxide, antimony pentoxide, sodium antimonate, potassium antimonate, and calcium antimonate. Examples of the composite metal containing zinc include zinc borate and zinc stannate. In terms of the effects of the flame retardant auxiliary on the flame resistance and the texture, the flame retardant auxiliary may be at least one selected from the group consisting of antimony trioxide, antimony pentoxide, and sodium antimonate.

<Phosphorus-Based Flame Retardant>

The phosphorus-based flame retardant contains at least one selected from the group consisting of a zinc phosphinate and a condensed phosphate ester compound.

Unlike other metal salts of e.g., aluminum, magnesium, barium, and calcium, except for zinc, the zinc phosphinate is melted at a resin processing temperature of the polyamide-based resin, and thus is finely and uniformly dispersed in the resin. This can make the texture and appearance of the fiber similar to human hair, and can also improve the combing property of the fiber. On the other hand, the use of phosphinates of metals other than zinc leads to poor texture and gloss of the fiber, so that the fiber cannot have a texture and gloss similar to human hair.

The zinc phosphinate is represented by, e.g., the general formula (3) and may be a commercially available product such as a phosphorus-based flame retardant (trade name "EXOLIT (registered trademark) OP950") manufactured by Clariant Chemicals Ltd. The phosphorus-based flame retardant (trade name "EXOLIT (registered trademark) OP950") has been developed especially for use with a polyester-based resin. Surprisingly, when the phosphorus-based flame retardant (trade name "EXOLIT (registered trademark) OP950") is added to the polyamide-based resin, and the mixture is melt-kneaded and then melt-spun, the phosphorus-based flame retardant is finely and uniformly dispersed in the polyamide-based resin. This can make the texture and appearance of the fiber similar to human hair, and can also improve the combing property of the fiber.

[Chemical formula 3]

(3)

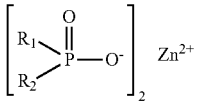

[Chemical Formula 2]

(2)

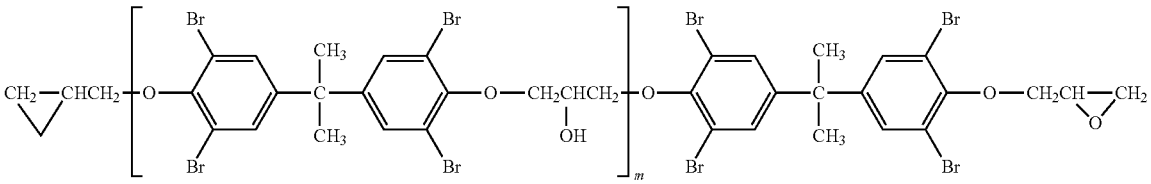

In the general formula (3), $R_1$ and $R_2$ are the same or different and represent a linear or branched alkyl group, phenyl group and/or aryl group, may represent a linear or branched C1 to C6 alkyl group and/or aryl group, or may represent methyl, ethyl, n-propyl, isopropyl, n-butyl, tert-butyl, n-pentyl, and/or phenyl.

Examples of the zinc phosphinate include zinc dimethylphosphinate, zinc methylethylphosphinate, zinc diethylphosphinate, zinc methyl-n-propylphosphinate, zinc ethyl-n-propylphosphinate, zinc methylphenylphosphinate, zinc ethylphenylphosphinate, and zinc diphenylphosphinate. The zinc phosphinate may be at least one selected from the group consisting of zinc dimethylphosphinate, zinc methylethylphosphinate, and zinc diethylphosphinate. The zinc phosphinate may be zinc diethylphosphinate.

Examples of the condensed phosphate ester compound include 1,3-phenylene bis(diphenyl phosphate), 1,3-phenylene bis(dixylenyl phosphate), bisphenol A bis(diphenyl phosphate), 2,2-bis(chloromethyl)trimethylene bis(bis(2-chloroethyl)phosphate), polyoxyalkylene bisdichloroalkyl phosphate, and an aromatic condensed phosphate ester polymer. The aromatic condensed phosphate ester polymer is preferred in terms of good fiber formability. The aromatic condensed phosphate ester polymer may be, e.g., a homopolymer or in the form of a copolymerized aromatic condensed phosphate ester polymer having two or more different repeating skeletons.

The weight average molecular weight of the aromatic condensed phosphate ester polymer may be 1,000 to 300,000 g/mol, 5,000 to 200,000 g/mol, or 10,000 to 150,000 g/mol in terms of e.g., dispersibility in a polyamide resin and heat resistance. In this case, the weight average molecular weight is determined by gel permeation chromatography (GPC), in which dimethylformamide is a solvent and a calibration curve is prepared using a polyvinyl chloride resin.

The aromatic condensed phosphate ester polymer may be a commercially available product such as a phosphorus-based flame retardant (trade name "Nofia HM1100" manufactured by RUC Polymers, Inc. The aromatic condensed phosphate ester polymer, typified by the phosphorus-based flame retardant (trade name "Nofia HM1100"), has high heat resistance and can be melt-kneaded with the polyamide resin. Moreover, the aromatic condensed phosphate ester polymer is not likely to bleed out of the resin, and thus can improve the texture of the artificial hair fiber.

<Core Resin Composition>

The core resin composition is not particularly limited as long as it contains a polyester-based resin. For example, the core resin composition may contain, as the main component resin, at least one resin selected from the group consisting of a polyester-based resin, a polyamide-based resin, a modacrylic-based resin, a polycarbonate-based resin, a polyolefin-based resin, and a polyphenylene sulfide-based resin. In terms of flame resistance and gloss, the core resin composition may be a polyester-based resin composition that contains a polyester-based resin as the main component resin, or a polyester-based resin composition that contains, as the main component resin, at least one polyester-based resin selected from the group consisting of polyalkylene terephthalate and a copolyester mainly containing polyalkylene terephthalate. The polyester-based resin composition may contain other resins in addition to the polyester-based resin as the main component resin. The content of the polyester-based resin as the main component resin may be more than 50% by weight, 70% by weight or more, 85% by weight or more, 90% by weight or more, yet more preferably 95% by weight or more, or 100% by weight with respect to 100% by weight of the total content of the resins in the polyester-based resin composition.

Examples of the polyalkylene terephthalate include, but are not particularly limited to, polyethylene terephthalate, polypropylene terephthalate, polybutylene terephthalate, and polycydohexane dimethylene terephthalate. Examples of the copolyester mainly containing the polyalkylene terephthalate include, but are not particularly limited to, copolyesters containing polyalkylene terephthalate such as polyethylene terephthalate, polypropylene terephthalate, polybutylene terephthalate, or polycydohexane dimethylene terephthalate as the main component and other copolymerizable components. The "copolyester mainly containing the polyalkylene terephthalate" refers to the copolyester containing 80 mol % or more of polyalkylene terephthalate.

Examples of the other copolymerizable components include the following: polycarboxylic acids such as isophthalic acid, orthophthalic acid, naphthalenedicarboxylic acid, paraphenylenedicarboxylic acid, trimellitic acid, pyromellitic acid, succinic acid, glutaric acid, adipic acid, suberic acid, azelaic acid, sebacic acid, and dodecanedioic acid and their derivatives; dicarboxylic acids containing sulfonates such as 5-sodium sulfoisophthalic acid and dihydroxyethyl 5-sodium sulfoisophthalate and their derivatives; 1,2-propanediol; 1,3-propanediol; 1,4-butanediol; 1,6-hexanediol; neopentyl glycol; 1,4-cydohexanedimethanol; diethylene glycol polyethylene glycol trimethylolpropane; pentaerythritol; 4-hydroxybenzoic acid; ε-caprolactone; and ethylene glycol ether of bisphenol A.

In terms of stability and ease of operation, the copolyester may be produced by mixing the polyalkylene terephthalate as the main component with a small amount of the other copolymerizable components and allowing them to react with each other. The polyalkylene terephthalate may be a polymer of a terephthalic acid and/or its derivatives (e.g., methyl terephthalate) with alkylene glycol. The copolyester may also be produced in the following manner. First, the terephthalic acid and/or its derivatives (e.g., methyl terephthalate) and alkylene glycol, which are used for the polymerization of the polyalkylene terephthalate, are mixed together. Then, the mixture is mixed with a small amount of the other copolymerizable components such as monomer or oligomer components, followed by polymerization.

To produce the copolyester, any copolymerization method may be used that enables polycondensation of the other copolymerizable components on the main chain and/or side chain of the polyalkylene terephthalate as the main component.

Specific examples of the copolyester mainly containing the polyalkylene terephthalate include copolyesters obtained by copolymerizing, e.g., polyethylene terephthalate as the main component with one compound selected from the group consisting of ethylene glycol ether of bisphenol A 1,4-cydohexanedimethanol, isophthalic acid, and dihydroxyethyl 5-sodium sulfoisophthalate.

The polyalkylene terephthalate and the copolyester mainly containing the polyalkylene terephthalate may be used individually or in combinations of two or more. In particular, it is preferable that the following examples may be used individually or in combinations of two or more, including: polyethylene terephthalate (also referred to as PET in the following); polypropylene terephthalate; polybutylene terephthalate (also referred to as PBT in the following); a copolyester of polyethylene terephthalate as the main component and ethylene glycol ether of bisphenol A; a copolyester of polyethylene terephthalate as the main component and 1,4-cydohexanedimethanol; a copolyester of polyethylene terephthalate as the main component and isophthalic acid; and a copolyester of polyethylene terephthalate as the main component and dihydroxyethyl 5-sodium sulfoisophthalate. It is more preferable that the following examples may be used individually or in combinations of two or more, including: polyethylene terephthalate; a copolyester of polyethylene terephthalate as the main component and ethylene glycol ether of bisphenol A; a copolyester of polyethylene terephthalate as the main component and 1,4-cydohexanedimethanol; a copolyester of polyethylene terephthalate as the main component and isophthalic acid; and a copolyester of polyethylene terephthalate as the main component and dihydroxyethyl 5-sodium sulfoisophthalate.

An intrinsic viscosity (IV value) of the polyester-based resin is not particularly limited, and may be 0.3 or more and 1.2 or less, or 0.4 or more and 1.0 or less. When the intrinsic viscosity is 0.3 or more, it is possible to prevent a decrease in the mechanical strength of the resulting fibers, and also to eliminate the risk of chipping during a flammability test. When the intrinsic viscosity is 1.2 or less, the molecular weight does not become too large and the melt viscosity does not become too high, thereby facilitating melt spinning and making the fineness of the fibers more likely to be uniform.

<Sheath Resin Composition>

The sheath resin composition is not particularly limited as long as it contains a polyamide-based resin. For example, the sheath resin composition may contain, as the main component resin, at least one resin selected from the group consisting of a polyester-based resin, a polyamide-based resin, a modacrylic-based resin, a polycarbonate-based resin, a polyolefin-based resin, and a polyphenylene sulfide-based resin. In terms of improving the texture, the sheath resin composition may be a polyamide-based resin composition that contains a polyamide-based resin as the main component resin. The polyamide-based resin composition may contain other resins in addition to the polyamide-based resin as the main component resin. The content of the polyamide-based resin as the main component resin may be more than 50% by weight, 70% by weight or more, 85% by weight or more, 90% by weight or more, 95% by weight or more, or 100% by weight with respect to 100% by weight of the total content of the resins in the polyamide-based resin composition.

The polyamide-based resin refers to a nylon resin obtained by polymerizing at least one selected from the group consisting of lactam, an aminocarboxylic acid, a mixture of a dicarboxylic acid and diamine, a mixture of a dicarboxylic acid derivative and diamine, and a salt of a dicarboxylic acid and diamine.

Specific examples of the lactam include, but are not particularly limited to, 2-azetidinone, 2-pyrrolidinone, δ-valerolactam, ε-caprolactam, enantholactam, caprylactam, undecalactam, and laurolactam. Among them, ε-caprolactam, undecalactam, and laurolactam are preferred, and ε-caprolactam is particularly preferred. These lactams may be used individually or in combinations of two or more.

Specific examples of the aminocarboxylic acid include, but are not particularly limited to, 6-aminocaproic acid, 7-aminoheptanoic acid, 8-aminooctanoic acid, 9-aminononanoic acid, 10-aminodecanoic acid, 11-aminoundecanoic acid, and 12-aminododecanoic acid. Among them, 6-aminocaproic acid, 11-aminoundecanoic acid, and 12-aminododecanoic acid are preferred, and 6-aminocaproic acid is particularly preferred. These aminocarboxylic acids may be used individually or in combinations of two or more.

Specific examples of the dicarboxylic acid, which is used in the mixture of a dicarboxylic acid and diamine, the mixture of a dicarboxylic acid derivative and diamine, or the salt of a dicarboxylic acid and diamine, include, but are not particularly limited to, the following: aliphatic dicarboxylic acids such as oxalic acid, malonic acid, succinic acid, glutaric acid, adipic acid, pimelic acid, suberic acid, azelaic acid, sebacic acid, undecanedioic acid, dodecanedioic acid, brasylic acid, tetradecanedioic acid, pentadecanedioic acid, and octadecanedioic acid; alicyclic dicarboxylic acids such as cydohexanedicarboxylic acid; and aromatic dicarboxylic acids such as phthalic acid, isophthalic acid, terephthalic acid, and naphthalenedicarboxylic acid. Among them, adipic acid, sebacic acid, dodecanedioic acid, terephthalic acid, and isophthalic acid are preferred, and adipic acid, terephthalic acid, and isophthalic acid are particularly preferred. These dicarboxylic adds may be used individually or in combinations of two or more.

Specific examples of the diamine, which is used in the mixture of a dicarboxylic acid and diamine, the mixture of a dicarboxylic acid derivative and diamine, or the salt of a dicarboxylic acid and diamine, include, but are not particularly limited to, the following: aliphatic diamines such as 1,4-diaminobutane, 1,5-diaminopentane, 1,6-diaminohexane, 2-methyl-1,5-diaminopentane (MDP), 1,7-diaminoheptane, 1,8-diaminooctane, 1,9-diaminononane, 1,10-diaminodecane, 1,11-diaminoundecane, 1,12-diaminododecane, 1,13-diaminotridecane, 1,14-diaminotetradecane, 1,15-diaminopentadecane, 1,16-diaminohexadecane, 1,17-diaminoheptadecane, 1,18-diaminooctadecane, 1,19-diaminononadecane, and 1,20-diaminoeicosane; alicyclic diamines such as cydohexanediamine and bis-(4-aminohexyl)methane; and aromatic diamines such as m-xylylenediamine and p-xylylenediamine. Among them, aliphatic diamines are preferred, and hexamethylenediamine is particularly preferred. These diamines may be used individually or in combinations of two or more.

Examples of the polyamide-based resin (nylon resin) include, but are not particularly limited to, nylon 6 (also referred to as PA6 in the following), nylon 66 (also referred to as PA66 in the following), nylon 11, nylon 12, nylon 6·10, nylon 6·12, semi-aromatic nylons including units of nylon 6T and/or nylon 61, and copolymers of these nylon resins. In particular, the polyamide-based resin mainly containing at least one selected from the group consisting of nylon 6 and nylon 66 is more preferred. The "polyamide-based resin mainly containing at least one selected from the group consisting of nylon 6 and nylon 66" refers to the polyamide-based resin containing 80 mol % or more of nylon 6 and/or nylon 66.

The polyamide-based resin can be produced by, e.g., a polyamide-based resin polymerization method that incudes heating materials for the polyamide-based resin in the presence or absence of a catalyst. The method may or may not include a stirring process during the polymerization, but it is preferable that the materials are stirred to obtain a homogeneous product. The polymerization temperature may be set as appropriate in accordance with the degree of polymerization of the target polymer, the reaction yield, and the reaction time, and may be set to be lower in view of the quality of the polyamide-based resin to be obtained. The reaction rate may also be set as appropriate. The pressure is not particularly limited, and it is preferable that the system is placed under reduced pressure to efficiently extract volatile components out of the system.

The ends of the polyamide-based resin may be capped with an end-capping agent such as a carboxylic acid compound or an amine compound, if necessary. When a monocarboxylic and or monoamine is used as an end-capping agent, the terminal amino group concentration or the terminal carboxyl group concentration of the resulting nylon resin is reduced compared to the case where such an end-capping agent is not used. On the other hand, when a dicarboxylic acid or diamine is used as an end-capping agent, the sum of the terminal amino group concentration and the terminal carboxyl group concentration is unchanged, but the ratio of the terminal amino group concentration to the terminal carboxyl group concentration is changed.

Specific examples of the carboxylic acid compound include, but are not particularly limited to, the following: aliphatic monocarboxylic acids such as acetic acid, propionic acid, butyric acid, valeric acid, caproic acid, enanthic acid, caprylic acid, pelargonic acid, undecanoic acid, lauric acid, tridecanoic acid, myristic acid, myristoleic acid, palmitic acid, stearic acid, oleic acid, linoleic acid, and arachic acid; alicyclic monocarboxylic acids such as cydohexanecarboxylic acid and methylcydohexanecarboxylic acid; aromatic monocarboxylic acids such as benzoic acid, toluic acid, ethylbenzoic acid, and phenylacetic acid; aliphatic dicarboxylic acids such as oxalic acid, malonic acid, succinic acid, glutaric acid, adipic acid, pimelic acid, suberic acid, azelaic acid, sebacic acid, undecanedioic acid, dodecanedioic acid, brasylic acid, tetradecanedioic acid, pentadecanedioic acid, and octadecanedioic acid; alicyclic dicarboxylic acids such as cydohexanedicarboxylic acid; and aromatic dicarboxylic acids such as phthalic acid, isophthalic acid, terephthalic acid, and naphthalenedicarboxylic acid.

Specific examples of the amine compound include, but are not particularly limited to, the following: aliphatic monoamines such as butylamine, pentylamine, hexylamine, heptylamine, octylamine, 2-ethylhexylamine, nonylamine, decylamine, undecylamine, dodecylamine, tridecylamine, tetradecylamine, pentadecylamine, hexadecylamine, octadecylamine, nonadecylamine, and icosylamine; alicyclic monoamines such as cydohexylamine and methylcydohexylamine; aromatic monoamines such as benzylamine and β-phenylethylamine; aliphatic diamines such as 1,4-diaminobutane, 1,5-diaminopentane, 1,6-diaminohexane, 1,7-diaminoheptane, 1,8-diaminooctane, 1,9-diaminononane, 1,10-diaminodecane, 1,11-diaminoundecane, 1,12-diaminododecane, 1,13-diaminotridecane, 1,14-diaminotetradecane, 1,15-diaminopentadecane, 1,16-diaminohexadecane, 1,17-diaminoheptadecane, 1,18-diaminooctadecane, 1,19-diaminononadecane, and 1,20-diaminoeicosane; alicyclic diamines such as cydohexanediamine and bis-(4-aminohexyl)methane; and aromatic diamines such as xylylenediamine.

Although the terminal group concentration of the polyamide-based resin is not particularly limited, the terminal amino group concentration may be high so as to improve dyeability for the intended use of the fibers. On the other hand, the terminal amino group concentration may be low so as to reduce coloration or gelation under long-term aging conditions. Moreover, both the terminal carboxyl group concentration and the terminal amino group concentration may be low so as to prevent the regeneration of lactam during remelting and filament breakage during melt spinning due to the formation of oligomers. The terminal group concentration may be adjusted according to the intended use, and both the terminal amino group concentration and the terminal carboxyl group concentration may be $1.0\times10^{-5}$ to $15.0\times10^{-5}$ eq/g, $2.0\times10^{-5}$ to $12.0\times10^{-5}$ eq/g, or $3.0\times10^{-5}$ to $11.0\times10^{-5}$ eq/g.

There are some methods to add the end-capping agent. For example, the end-capping agent may be (i) added simultaneously with materials such as caprolactam in the initial stage of polymerization, (ii) added in the process of polymerization, or (iii) added while the molten nylon resin is passing through a vertical stirring-type thin film evaporator. The end-capping agent may be added as it is, or added after having been dissolved in a small amount of solvent.

<Method for Producing Core-Sheath Conjugate Fiber for Artificial Hair>

The core-sheath conjugate fibers for artificial hair may be produced in the following manner. For example, the core resin composition and the sheath resin composition each are melt-kneaded, pelletized, and then melt-spun through a core-sheath type conjugate spinneret. Examples of a kneading machine used for melt kneading include a single-screw extruder, a twin-screw extruder, a roll, a Banbury mixer, and a kneader. In particular, the twin-screw extruder is preferred in terms of the adjustment of the degree of kneading and ease of operation.

In melt spinning, e.g., when the core resin composition is a polyester-based resin composition and the sheath resin composition is a polyamide-based resin composition, each of the resin compositions is melted and extruded under the conditions that the temperatures of the extruder, the gear pump, the spinneret, etc., are set at 250° C. or more and 300° C. or less. Then, the extrudate is wound up at a speed of 30 m/min or more and 5000 m/min or less, resulting in spun yarns (undrawn yarns) Specifically, the core resin composition is supplied from a core extruder and the sheath resin composition is supplied from a sheath extruder. The molten polymer is forced through a core-sheath type conjugate spinning nozzle (holes) with a predetermined shape, and thus the spun yarns (undrawn yarns) are obtained. The cross-sectional shape of the core-sheath conjugate fibers, the cross-sectional shape of the core, the core-to-sheath ratio, or the like can be controlled by using, e.g., the nozzle (holes) with a shape dose to the desired cross-sectional shape.

Moreover, the spun yarns may be cooled in a water bath containing cooling water in order to control the fineness. The temperature and the length of a heated tube, the temperature and the amount of cooling air to be applied, the temperature of the cooling water bath, the cooling time, and the winding speed may be set as appropriate in accordance with the extrusion rate of the polymer and the number of spinneret holes.

It is preferable that the spun yarns (undrawn yarns) are drawn. The drawing may be performed by either a two-step method or a direct spinning-drawing method. In the two-step method, the spun yarns are once wound, and then drawn. In the direct spinning-drawing method, the spun yarns are drawn continuously without winding. The drawing may be performed by a single-stage drawing method or a multi-stage drawing method that includes two or more stages.

The heating means in the drawing may be, e.g., a heating roller, a heat plate, a steam jet apparatus, or a hot water bath, and they can be used in combination as appropriate.

Oils such as a fiber treatment agent and a softening agent may be applied to the core-sheath conjugate fibers for artificial hair to make the texture and feel of the fibers more similar to human hair. The fiber treatment agent may be, e.g., a silicone-based fiber treatment agent or a non-silicone-based fiber treatment agent used to improve the texture and combing property of the fibers.

The core-sheath conjugate fibers for artificial hair may contain various additives as needed, to the extent that they do not interfere with the purpose of one or more embodiments of the present invention. The additives include, e.g., a delustering agent, a crystal nucleating agent, a dispersing agent, a lubricant, a heat-resistant agent, a stabilizer, a fluorescent agent, an antioxidant, an antistatic agent, and a pigment.

The core-sheath conjugate fibers for artificial hair may be subjected to gear crimping. The gear crimping imparts gentle curves and natural appearance to the fibers, and also reduces the adhesion between the fibers, thereby further improving the combing property. In the gear crimping, the fibers are generally heated to a temperature higher than the softening temperature and allowed to pass through two engaged gears so that the shape of the gears is transferred to the fibers. This can create curls on the fibers.

The single fiber fineness of the core-sheath conjugate fibers for artificial hair may be 10 dtex or more and 200 dtex or less, 30 dtex or more and 180 dtex or less, 40 dtex or more and 150 dtex or less, or 50 dtex or more and 100 dtex or less because the core-sheath conjugate fibers with this single fiber fineness are suitable for artificial hair as an alternative to human hair.

When the core-sheath conjugate fibers for artificial hair are in the form of an aggregate of fibers, e.g., a fiber bundle, all the fibers do not necessarily have the same fineness and cross-sectional shape, but some of them may have different fineness and cross-sectional shape.

The core-sheath conjugate fibers for artificial hair can be used as artificial hair either individually or in combination with other artificial hair fibers and natural fibers such as human hair and animal hair.

<Hair Ornaments>

The core-sheath conjugate fibers for artificial hair may be used for hair ornaments. The hair ornaments include, but are not particularly limited to, hair wigs, hairpieces, weaving hair, hair extensions, braided hair, hair accessories, and doll hair.

The hair ornaments may include only the core-sheath conjugate fibers for artificial hair of one or more embodiments of the present invention. Alternatively, the hair ornaments may include the core-sheath conjugate fibers for artificial hair of the present invention in combination with other artificial hair fibers and natural fibers such as human hair and animal hair.

EXAMPLES

Hereinafter, one or more embodiments of the present invention will be described in more detail by way of examples. However, one or more embodiments of the present invention are not limited to the following examples.

The measurement methods and the evaluation methods used in Examples and Comparative Examples are as follows.

(Single Fiber Fineness)

Using an auto-vibronic fineness measuring device "DENIER COMPUTER DC-11" (manufactured by SEARCH CO., LTD), 30 samples were measured to determine their respective single fiber fineness, and the average of the measured values of the samples was calculated and taken as the single fiber fineness of the core-sheath conjugate fibers.

(Texture)

Sensory evaluation was performed by a professional cosmetologist, and the texture was evaluated in the following four stages.

A: The texture is very good and equivalent to human hair.
B: The texture is good, but slightly inferior to human hair.
C: The texture is poor and inferior to human hair.
D: The texture is poor and significantly inferior to human hair.

(Combing Property)

First, fibers were cut into 70 cm long in the uncurled state, and 25 g of the 70 cm-long fibers were bundled together. Then, a string was tied in the middle of the fiber bundle, which was folded in two and fixed by the string. Thus, a fiber bundle for hair ironing was prepared. Next, the fiber bundle was clamped in a hair iron ("IZUNAMI ITC450 Flat Iron" manufactured by Izunami Inc. in the U.S.) that had been heated at 180° C. The fiber bundle was heated while the hair iron was pulled along the length of the fiber bundle from the fixed root to the tip. This process was repeated five times, providing a fiber bundle for evaluation of the combing property. Subsequently, the fiber bundle for evaluation of the combing property was combed 100 times by running a hair comb ("MATADOR PROFESSIONAL 386.81/2F" made in Germany) from the fixed root to the tip of the fiber bundle. Based on the number of deformed or split fibers, the combing property was evaluated in the following four stages.

A: The number of deformed or split fibers after 100 times of combining is less than 10, and the fiber bundle is combed through to the end with no resistance.
B: The number of deformed or split fibers after 100 times of combining is 10 or more and less than 30, and the fiber bundle is combed through to the end with slightly high resistance in the middle.
C: The number of deformed or split fibers after 100 times of combining is 30 or more and less than 100, and the fiber bundle is combed with high resistance in the middle, so that the comb cannot pass through the fiber bundle once to less than 20 times out of 100 times.
D: The number of deformed or split fibers after 100 times of combining is 100 or more, and the fiber bundle is combed with high resistance in the middle, so that the comb cannot pass through the fiber bundle 20 times or more out of 100 times.

(Gloss)

Sensory evaluation was performed with visual inspection, and the gloss was evaluated in the following four stages.

A: The gloss is significantly reduced as compared to nylon mono-component fibers, and thus is very similar to that of human hair.
B: The gloss is greatly reduced as compared to nylon mono-component fibers, and thus is similar to that of human hair.
C: The gloss is not much reduced or is excessively reduced as compared to nylon mono-component fibers, and thus is different from that of human hair.
D: The gloss is not reduced or is more excessively reduced as compared to nylon mono-component fibers, and thus is considerably different from that of human hair.

(Flame Resistance)

First, fibers were cut into 17 to 18 cm long, and 0.25 g of the 17 to 18 cm-long fibers were weighed as a sample. In this manner, eight samples were prepared. The fibers of each sample were twisted by turning the two ends of the fibers, and then folded in half Thus, twisted strings (n=8) were obtained. Next, a limiting oxygen index (IDI value) of the fibers for each of the twisted strings was measured by an oxygen index flammability tester. The LOI value indicates an oxygen concentration that enables the twisted string to burn 5 an or to keep burning for 3 minutes. In the measurement, the oxygen flow rate and the nitrogen flow rate were set to predetermined values, and the LOI value was calculated by the following formula (1). In the formula (1), the "number of extinguished strings" means the total number of the twisted strings that did not burn or stopped burning before reaching 5 cm.

$$\text{LOT value}=0.5+8\times(\text{the number of extinguished strings})+\text{oxygen concentration (\%)} \quad (1)$$

Based on the measured LOI value, the flame resistance was evaluated in the following three stages, and B or higher was considered acceptable.

A: 27 or more

B: 26 or more and less than 27

C: less than 26

Example 1

Frist, 100 parts by weight of polyethylene terephthalate pellets (EastPET trade name "A-12" manufactured by East West Chemical Private Limited) were mixed with 29 parts by weigh of a brominated epoxy-based flame retardant (trade name "SR-T2ME" manufactured by Sakamoto Yakuhin Kogyo Co., Ltd), 3 parts by weight of sodium antimonate (trade name "SA-A" manufactured by NIHON SEIKO CO., LTD) as a flame retardant auxiliary, 2.1 parts by weight of black pigment masterbatch (trade name "PESM 22367 BLACK (20)" manufactured by Dainichiseika Color & Chemicals Mfg. Co., Ltd., pigment: 20% by weight, base resin: polyester-based resin), 0.8 parts by weight of yellow pigment masterbatch (trade name "PESM 1001 YELLOW (20" manufactured by Dainichiseika Color & Chemicals Mfg. Co., Ltd, pigment: 20% by weight, base resin: polyester-based resin), and 0.6 parts by weight of red pigment masterbatch (trade name "PESM 3005 RED (20)" manufactured by Dainichiseika Color & Chemicals Mfg. Co., Ltd, pigment: 20% by weight, base resin: polyester-based resin). The mixture was dry blended and then fed into a twin-screw extruder, where it was melt-kneaded at a barrel temperature of 280° C. and pelletized. Thus, a polyester-based resin composition was obtained.

Moreover, 100 parts by weight of nylon 6 (trade name "A1030BRL" manufactured by UNIT KA LTD) were mixed with 10 parts by weight of a phosphorus-based flame retardant A (trade name "EXOLIT (registered trademark) OP950" manufactured by Clariant Chemicals Ltd., zinc diethylphosphinate), 2.1 parts by weight of black pigment masterbatch (trade name "PESM 22367 BLACK (20)" manufactured by Dainichiseika Color & Chemicals Mfg. Co., Ltd), 0.8 parts by weight of yellow pigment masterbatch (trade name "PESM 1001 YELLOW (20)" manufactured by Dainichiseika Color & Chemicals Mt. Co., Ltd.), and 0.6 parts by weight of red pigment masterbatch (trade name "PESM 3005 RED (20)" manufactured by Dainichiseika Color & Chemicals Mfg. Co., Ltd). The mixture was dry blended and then fed into a twin-screw extruder, where it was melt-kneaded at a barrel temperature of 260° C. and pelletized. Thus, a polyamide-based resin composition was obtained.

Next, the polyester-based resin composition in the form of pellets and the polyamide-based resin composition in the form of pellets were fed into extruders, respectively, and then forced through a concentric core-sheath type conjugate spinning nozzle (having 120 holes with a hole diameter of 1.5 mm) at a set temperature of 270° C. and wound up at a speed of 40 to 200 m/min. This resulted in undrawn yarns of core-sheath conjugate fibers containing the polyester-based resin composition as a core and the polyamide-based resin composition as a sheath and having a core-to-sheath area ratio of 5:5.

The undrawn yarns thus obtained were drawn to 3 times and taken up at a speed of 45 m/min by using a heating roller at 85° C. Subsequently, the drawn yarns were further heat-treated and wound up at a speed of 45 m/min by using a heating roller at 205° C. A polyether oil (trade name "KWC-Q" manufactured by Marubishi Oil Chemical Corporation) was applied to the drawn yarns so that the amount of oil applied was 0.20% omf (i.e., the weight percentage of the oil (pure content) with respect to the dry fiber weight). Then, the resulting yarns were dried, and thus core-sheath conjugate fibers (with a single fiber fineness of 58 dtex) were obtained.

Example 2

Core-sheath conjugate fibers (with a single fiber fineness of 58 dtex) were produced in the same manner as Example 1 except that the core resin composition was changed in which 30 parts by weight of the brominated epoxy-based flame retardant and 2 parts by weight of the sodium antimonate were added to 100 parts by weight of polyethylene terephthalate, and the sheath resin composition was changed in which 10 parts by weight of the brominated epoxy-based flame retardant, 2 parts by weight of the sodium antimonate, and 3 parts by weight of the phosphorus-based flame retardant A were added to 100 parts by weight of nylon 6.

Example 3

Core-sheath conjugate fibers (with a single fiber fineness of 58 dtex) were produced in the same manner as Example 1 except that the core resin composition was changed in which 30 parts by weight of the brominated epoxy-based flame retardant and 2 parts by weight of the sodium antimonate were added to 100 parts by weight of polyethylene terephthalate, and the sheath resin composition was changed in which 10 parts by weight of the brominated epoxy-based flame retardant, 2 parts by weight of the sodium antimonate, and 5 parts by weight of the phosphorus-based flame retardant A were added to 100 parts by weight of nylon 6.

Example 4

Core-sheath conjugate fibers (with a single fiber fineness of 58 dtex) were produced in the same manner as Example 1 except that the sheath resin composition was changed in which 12 parts by weight of a phosphorus-based flame retardant D (trade name "Nofia HM1100" manufactured by FRX Polymers, Inc., an aromatic condensed phosphate ester polymer, a homopolymer, weight average molecular weight: 43000 g/mol) was added to 100 parts by weight of nylon 6.

Example 5

Core-sheath conjugate fibers (with a single fiber fineness of 58 dtex) were produced in the same manner as Example 1 except that the sheath resin composition was changed in which 20 parts by weight of the phosphorus-based flame retardant D (trade name "Nofia HM1100" manufactured by FRX Polymers, Inc., an aromatic condensed phosphate ester polymer, a homopolymer, weight average molecular weight: 43000 g/mol) was added to 100 parts by weight of nylon 6.

Comparative Example 1

Core-sheath conjugate fibers (with a single fiber fineness of 58 dtex) were produced in the same manner as Example 1 except that the sheath resin composition was changed in which 10 parts by weight of a phosphorus-based flame retardant B (trade name "EXOLIT (registered trademark) OP1400") manufactured by Clariant Chemicals Ltd., aluminum phosphinate) was added to 100 parts by weight of nylon 6.

Comparative Example 2

Core-sheath conjugate fibers (with a single fiber fineness of 58 dtex) were produced in the same manner as Example 1 except that the sheath resin composition was changed in which 10 parts by weight of a phosphorus-based flame retardant C (trade name "EXOLIT (registered trademark) OP935") manufactured by Clariant Chemicals Ltd., aluminum phosphinate) was added to 100 parts by weight of nylon 6.

Comparative Example 3

Core-sheath conjugate fibers (with a single fiber fineness of 58 dtex) were produced in the same manner as Example 1 except that the core resin composition was changed in which 30 parts by weight of the brominated epoxy-based flame retardant and 2 parts by weight of the sodium antimonate were added to 100 parts by weight of polyethylene terephthalate, and the sheath resin composition was changed in which 15 parts by weight of the brominated epoxy-based flame retardant and 2 parts by weight of the sodium antimonate were added to 100 parts by weight of nylon 6.

Comparative Example 4

Core-sheath conjugate fibers (with a single fiber fineness of 58 dtex) were produced in the same manner as Example 1 except that the core resin composition was changed in which 30 parts by weight of the brominated epoxy-based flame retardant and 2 parts by weight of the sodium antimonate were added to 100 parts by weight of polyethylene terephthalate, and the sheath resin composition was changed in which 20 parts by weight of the brominated epoxy-based flame retardant and 2 parts by weight of the sodium antimonate were added to 100 parts by weight of nylon 6.

Comparative Example 5

Core-sheath conjugate fibers (with a single fiber fineness of 58 dtex) were produced in the same manner as Example 1 except that the core resin composition was changed in which 20 parts by weight of the brominated epoxy-based flame retardant and 2 parts by weight of the sodium antimonate were added to 100 parts by weight of polyethylene terephthalate, and the sheath resin composition was changed in which 10 parts by weight of the brominated epoxy-based flame retardant, 2 parts by weight of the sodium antimonate, and 3 parts by weight of the phosphorus-based flame retardant A were added to 100 parts by weight of nylon 6.

Comparative Example 6

Core-sheath conjugate fibers (with a single fiber fineness of 58 dtex) were produced in the same manner as Example 1 except that the core resin composition was changed in which 20 parts by weight of the brominated epoxy-based flame retardant and 2 parts by weight of the sodium antimonate were added to 100 parts by weight of polyethylene terephthalate, and the sheath resin composition was changed in which 10 parts by weight of the brominated epoxy-based flame retardant, 2 parts by weight of the sodium antimonate, and 5 parts by weight of the phosphorus-based flame retardant A were added to 100 parts by weight of nylon 6.

Comparative Example 7

Core-sheath conjugate fibers (with a single fiber fineness of 58 dtex) were produced in the same manner as Example 1 except that the core resin composition was changed in which 20 parts by weight of the brominated epoxy-based flame retardant and 2 parts by weight of the sodium antimonate were added to 100 parts by weight of polyethylene terephthalate, and the sheath resin composition was changed in which 15 parts by weight of the brominated epoxy-based flame retardant and 2 parts by weight of the sodium antimonate were added to 100 parts by weight of nylon 6.

Comparative Example 8

Core-sheath conjugate fibers (with a single fiber fineness of 58 dtex) were produced in the same manner as Example 1 except that the core resin composition was changed in which 35 parts by weight of the brominated epoxy-based flame retardant and 12 parts by weight of the sodium antimonate were added to 100 parts by weight of polyethylene terephthalate, and the sheath resin composition was changed in which 30 parts by weight of the brominated epoxy-based flame retardant and 5 parts by weight of the sodium antimonate were added to 100 parts by weight of nylon 6.

The texture, combing property, gloss, and flame resistance of the core-sheath conjugate fibers for artificial hair in each of the Examples and the Comparative Examples were evaluated in the manner as described above. Table 1 shows the results.

TABLE 1

| | | Example | | | | | Comparative Example | | | | | | | |
|---|---|---|---|---|---|---|---|---|---|---|---|---|---|---|
| | | 1 | 2 | 3 | 4 | 5 | 1 | 2 | 3 | 4 | 5 | 6 | 7 | 8 |
| Core-to-sheath ratio (volume ratio) core:sheath | | 5:5 | 5:5 | 5:5 | 5:5 | 5:5 | 5:5 | 5:5 | 5:5 | 5:5 | 5:5 | 5:5 | 5:5 | 5:5 |
| Amount (part by weight) of component in core composition | Main component resin | 100 | 100 | 100 | 100 | 100 | 100 | 100 | 100 | 100 | 100 | 100 | 100 | 100 |
| | Bromine-based flame retardant | 29 | 30 | 30 | 29 | 29 | 29 | 29 | 30 | 30 | 20 | 20 | 20 | 35 |
| | Flame retardant auxiliary | 3 | 2 | 2 | 3 | 3 | 3 | 3 | 2 | 2 | 2 | 2 | 2 | 12 |

TABLE 1-continued

| | | Example | | | | | Comparative Example | | | | | | | |
|---|---|---|---|---|---|---|---|---|---|---|---|---|---|---|
| | | 1 | 2 | 3 | 4 | 5 | 1 | 2 | 3 | 4 | 5 | 6 | 7 | 8 |
| Amount (part by weight) of component in sheath composition | Main component resin | 100 | 100 | 100 | 100 | 100 | 100 | 100 | 100 | 100 | 100 | 100 | 100 | 100 |
| | Bromine-based flame retardant | 0 | 10 | 10 | 0 | 0 | 0 | 0 | 15 | 20 | 10 | 10 | 15 | 30 |
| | Flame retardant auxiliary | 0 | 2 | 2 | 0 | 0 | 0 | 0 | 2 | 2 | 2 | 2 | 2 | 5 |
| | Phosphorus-based flame retardant A | 10 | 3 | 5 | 0 | 0 | 0 | 0 | 0 | 0 | 3 | 5 | 0 | 0 |
| | Phosphorus-based flame retardant B | 0 | 0 | 0 | 0 | 0 | 10 | 0 | 0 | 0 | 0 | 0 | 0 | 0 |
| | Phosphorus-based flame retardant C | 0 | 0 | 0 | 0 | 0 | 0 | 10 | 0 | 0 | 0 | 0 | 0 | 0 |
| | Phosphorus-based flame retardant D | 0 | 0 | 0 | 12 | 20 | 0 | 0 | 0 | 0 | 0 | 0 | 0 | 0 |
| Amount (part by weight) of component in core-sheath conjugate fiber for artificial hair | Main component resin in core | 50 | 50 | 50 | 50 | 50 | 50 | 50 | 50 | 50 | 50 | 50 | 50 | 50 |
| | Main component resin in sheath | 50 | 50 | 50 | 50 | 50 | 50 | 50 | 50 | 50 | 50 | 50 | 50 | 50 |
| | Total of main component resin | 100 | 100 | 100 | 100 | 100 | 100 | 100 | 100 | 100 | 100 | 100 | 100 | 100 |
| | Total of flame retardant and flame retardant auxiliary | 21.0 | 23.5 | 24.5 | 22.0 | 26.0 | 21.0 | 21.0 | 24.5 | 27.0 | 18.5 | 19.5 | 19.5 | 41.0 |
| Core-sheath conjugate fiber for artificial hair | LOI value | 27.0 | 26.6 | 27.0 | 26.3 | 27.4 | 26.3 | 26.5 | 25.5 | 25.8 | 25.8 | 25.6 | 25.1 | 27.0 |
| | Flame resistance | A | B | A | B | A | B | B | C | C | C | C | C | A |
| | Texture | B | A | A | A | A | C | C | A | B | A | A | A | C |
| | Gloss | A | A | A | B | B | D | D | A | A | A | A | A | C |
| | Combing property | A | A | A | A | B | B | B | A | B | A | A | A | B |

As can be seen from Table 1, the core-sheath conjugate fibers for artificial hair of Examples 1 to 3, containing the zinc phosphinate as a flame retardant in the sheath, had a texture and appearance (gloss) similar to human hair, good combing property, and high flame resistance.

Moreover, the core-sheath conjugate fibers for artificial hair of Examples 4 and 5, containing the aromatic condensed phosphate ester polymer as a flame retardant in the sheath, had a texture and appearance (gloss) similar to human hair, good combing property, and high flame resistance.

On the other hand, the core-sheath conjugate fibers for artificial hair of Comparative Examples 1 and 2, containing the aluminum phosphinate as a flame retardant in the sheath, had a texture and appearance (gloss) significantly different from human hair and lower flame resistance than that of Example 1.

The core-sheath conjugate fibers for artificial hair of Comparative Examples 3 and 4, containing only the bromine-based flame retardant in the sheath, had low flame resistance in general. The amount of the flame retardant added to the sheath was larger in Comparative Example 4 than in Comparative Example 3. Comparative Example 4 was inferior to Comparative Example 3 in texture and combing property. Thus, it was difficult to ensure both the flame resistance and the properties such as texture, gloss, and combing property in Comparative Examples 3 and 4. The core-sheath conjugate fibers for artificial hair of Comparative Examples 5 to 7 had lower flame resistance because the amount of the flame retardant was small. The core-sheath conjugate fibers for artificial hair of Comparative Example 8 had high flame resistance due to a large amount of the flame retardant, but differed significantly from human hair in texture and appearance.

One or more embodiments of the present invention include, e.g., the following one or more embodiments, but is not limited thereto.

[1] A core-sheath conjugate fiber for artificial hair comprising:

a core and a sheath covering the core, wherein the core is composed of a core resin composition containing a polyester-based resin, and the sheath is composed of a sheath resin composition containing a polyamide-based resin, the core resin composition contains a bromine-based flame retardant and a flame retardant auxiliary, the sheath resin composition contains a phosphorus-based flame retardant, the phosphorus-based flame retardant contains at least one selected from the group consisting of a zinc phosphinate and a condensed phosphate ester compound, and a total amount of the bromine-based flame retardant, the phosphorus-based flame retardant, and the flame retardant auxiliary in the core-sheath conjugate fiber for artificial hair is 20 parts by weight or more and 40 parts by weight or less with respect to 100 parts by weight of a total amount of a main component resin of the core and a main component resin of the sheath.

[2] The core-sheath conjugate fiber for artificial hair according to [1], wherein a total amount of the bromine-based flame retardant and the flame retardant auxiliary in the core resin composition is 20 parts by weight or more and 40 parts by weight or less with respect to 100 parts by weight of the main component resin, and an amount of the phosphorus-based flame retardant in the sheath resin composition is 3 parts by weight or more and 20 parts by weight or less with respect to 100 parts by weight of the main component resin.

[3] The core-sheath conjugate fiber for artificial hair according to [1] or [2], wherein the sheath resin composition contains the bromine-based flame retardant in an amount of 5 parts by weight or more and 20 parts by weight or less with respect to 100 parts by weight of the main component resin.

[4] The core-sheath conjugate fiber for artificial hair according to any one of [1] to [3], wherein the core resin composition and the sheath resin composition each contain the flame retardant auxiliary in an amount of 1 part by weight or more and 5 parts by weigh or less with respect to 100 parts by weight of the main component resin.

[5] The core-sheath conjugate fiber for artificial hair according to any one of [1] to [4], wherein a core-to-sheath area ratio of the core to the sheath is 2:8 to 7:3.

[6] The core-sheath conjugate fiber for artificial hair according to any one of [1] to [5], wherein the core is composed of a resin composition that contains, as the main component resin, at least one polyester-based resin selected from the group consisting of polyalkylene terephthalate and a copolyester mainly containing polyalkylene terephthalate.

[7] The core-sheath conjugate fiber for artificial hair according to any one of [1] to [6], wherein the sheath is composed of a resin composition that contains, as the main component resin, a polyamide-based resin mainly containing at least one selected from the group consisting of nylon 6 and nylon 66.

[8] A hair ornament comprising the core-sheath conjugate fiber for artificial hair according to any one of [1] to [7].

[9] The hair ornament according to [8], wherein the hair ornament is any one selected from the group consisting of a hair wig, a hairpiece, weaving hair, a hair extension, braided hair, a hair accessory, and doll hair.

Although the disclosure has been described with respect to only a limited number of embodiments, those skilled in the art, having benefit of this disclosure, will appreciate that various other embodiments may be devised without departing from the scope of the present disclosure. Accordingly, the scope of the invention should be limited only by the attached claims.

The invention claimed is:

1. A core-sheath conjugate fiber for artificial hair comprising:

a core; and a sheath covering the core, wherein:

the core comprises a core resin composition comprising a polyester-based resin and the sheath comprises a sheath resin composition comprising a polyamide-based resin, the core resin composition comprises a bromine-based flame retardant and a flame retardant auxiliary, the sheath resin composition comprises a phosphorus-based flame retardant, the phosphorus-based flame retardant comprises at least one selected from the group consisting of a zinc phosphinate and a condensed phosphate ester compound, and a total amount of the bromine-based flame retardant, the phosphorus-based flame retardant, and the flame retardant auxiliary in the core-sheath conjugate fiber for artificial hair is 20 parts by weight or more and 40 parts by weight or less with respect to 100 parts by weight of a total amount of a main component resin of the core and a main component resin of the sheath.

2. The core-sheath conjugate fiber for artificial hair according to claim 1, wherein:

a total amount of the bromine-based flame retardant and the flame retardant auxiliary in the core resin composition is 20 parts by weight or more and 40 parts by weight or less with respect to 100 parts by weight of the main component resin; and an amount of the phosphorus-based flame retardant in the sheath resin composition is 3 parts by weight or more and 20 parts by weight or less with respect to 100 parts by weight of the main component resin.

3. The core-sheath conjugate fiber for artificial hair according to claim 1, wherein the sheath resin composition comprises the bromine-based flame retardant in an amount of 5 parts by weight or more and 20 parts by weight or less with respect to 100 parts by weight of the main component resin.

4. The core-sheath conjugate fiber for artificial hair according to claim 1, wherein the core resin composition and the sheath resin composition each comprise the flame retardant auxiliary in an amount of 1 part by weight or more and 5 parts by weigh or less with respect to 100 parts by weight of the main component resin.

5. The core-sheath conjugate fiber for artificial hair according to claim 1, wherein a core-to-sheath area ratio of the core to the sheath is 2:8 to 7:3.

6. The core-sheath conjugate fiber for artificial hair according to claim 1, wherein the core comprises a resin composition that comprises, as the main component resin, at least one polyester-based resin selected from the group consisting of polyalkylene terephthalate and a copolyester mainly comprising polyalkylene terephthalate.

7. The core-sheath conjugate fiber for artificial hair according to claim 1, wherein the sheath comprises a resin composition that comprises, as the main component resin, a polyamide-based resin mainly comprising at least one selected from the group consisting of nylon 6 and nylon 66.

8. The core-sheath conjugate fiber for artificial hair according to claim 1, wherein the zinc phosphinate is represented by the following general formula (3):

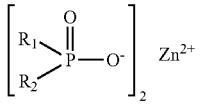

(3)

where $R_1$ and $R_2$ are the same or different and are each selected from the group consisting of a linear alkyl group, a branched alkyl group, a phenyl group, and an aryl group.

9. The core-sheath conjugate fiber for artificial hair according to claim 1, wherein the condensed phosphate ester compound comprises an aromatic condensed phosphate ester compound.

10. A hair ornament comprising the core-sheath conjugate fiber for artificial hair according to claim 1.

11. The hair ornament according to claim 10, wherein the hair ornament is any one selected from the group consisting of a hair wig, a hairpiece, weaving hair, a hair extension, braided hair, a hair accessory, and doll hair.

12. The hair ornament according to claim 10, wherein:

a total amount of the bromine-based flame retardant and the flame retardant auxiliary in the core resin composition is 20 parts by weight or more and 40 parts by weight or less with respect to 100 parts by weight of the main component resin; and an amount of the phosphorus-based flame retardant in the sheath resin composition is 3 parts by weight or more and 20 parts by weight or less with respect to 100 parts by weight of the main component resin.

13. The hair ornament according to claim 10, wherein the sheath resin composition comprises the bromine-based flame retardant in an amount of 5 parts by weight or more and 20 parts by weight or less with respect to 100 parts by weight of the main component resin.

14. The hair ornament according to claim 10, wherein the core resin composition and the sheath resin composition each comprise the flame retardant auxiliary in an amount of 1 part by weight or more and 5 parts by weigh or less with respect to 100 parts by weight of the main component resin.

15. The hair ornament according to claim 10, wherein a core-to-sheath area ratio of the core to the sheath is 2:8 to 7:3.

16. The hair ornament according to claim 10, wherein the core comprises a resin composition that comprises, as the main component resin, at least one polyester-based resin selected from the group consisting of polyalkylene terephthalate and a copolyester mainly comprising polyalkylene terephthalate.

17. The hair ornament according to claim 10, wherein the sheath comprises a resin composition that comprises, as the main component resin, a polyamide-based resin mainly comprising at least one selected from the group consisting of nylon 6 and nylon 66.

18. The hair ornament according to claim 10, wherein the zinc phosphinate is represented by the following general formula (3):

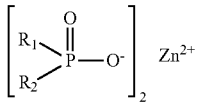

(3)

where $R_1$ and $R_2$ are the same or different and are each selected from the group consisting of a linear alkyl group, a branched alkyl group, a phenyl group, and an aryl group.

19. The hair ornament according to claim 10, wherein the condensed phosphate ester compound comprises an aromatic condensed phosphate ester compound.

* * * * *